US006532940B1

(12) United States Patent
Ono et al.

(10) Patent No.: US 6,532,940 B1
(45) Date of Patent: Mar. 18, 2003

(54) FUEL INJECTION CONTROL SYSTEM FOR CYLINDER INJECTION TYPE INTERNAL COMBUSTION ENGINE

(75) Inventors: Takahiko Ono, Hyogo (JP); Norihisa Fukutomi, Tokyo (JP); Hirofumi Ohuchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 4 days.

(21) Appl. No.: 09/702,815

(22) Filed: Nov. 1, 2000

(30) Foreign Application Priority Data

Apr. 28, 2000 (JP) ..... 2000-131349

(51) Int. Cl.[7] ..... H01H 7/16; F02M 51/00
(52) U.S. Cl. ..... 123/490; 361/154
(58) Field of Search ..... 361/144, 152, 361/154; 123/490

(56) References Cited

U.S. PATENT DOCUMENTS 4,140,084 A * 2/1979 Di Nunzio ..... 123/490
4,338,651 A * 7/1982 Henrich ..... 123/490
4,479,161 A * 10/1984 Henrich et al. ..... 123/478
5,992,391 A * 11/1999 Yamakado et al. ..... 123/490

FOREIGN PATENT DOCUMENTS

JP 58-152133 9/1983
JP 10-47140 2/1998

* cited by examiner

*Primary Examiner*—Gene Mancene
*Assistant Examiner*—Arnold Castro
(74) *Attorney, Agent, or Firm*—Sughrue Mion, PLLC

(57) ABSTRACT

A fuel injection control system of low cost for a cylinder injection type internal combustion engine, which system is capable of preventing degradation of fuel injection quantity accuracy which may be brought about by disturbances such as change of a battery voltage, change of resistance of a plunger coil of the fuel injection valve (1) and change of the fuel pressure (Fp) acting on the fuel injection valve (1) which may occur in the course of overexcitation driving of the fuel injection valve (1) at a battery voltage, to thereby allow the fuel injection quantity control to be secured for the fuel injection valve (1) over an extended range. The fuel injection control system includes an overexcitation drive means (2) for outputting a overexcitation current to the fuel injection valve (1) at a battery voltage, a holding drive means (3) for outputting a holding current smaller than the overexcitation current for holding the fuel injection valve (1) in a valve open state, a fuel injection valve control means (4) for changing over output operation of the overexcitation drive means (2) with output operation of the holding drive means (3) to thereby control driving operation for the fuel injection valve (1), and a switching time-point change means (6) for changing a time point for switching the output operation of the overexcitation drive means (2) to the output operation of the holding drive means (3).

6 Claims, 17 Drawing Sheets

FUEL INJECTION CONTROL SYSTEM FOR CYLINDER INJECTION TYPE INTERNAL COMBUSTION ENGINE

BACKGROUND OF THE INVENTION

1. Field of the Invention

The present invention generally relates to a fuel injection control system for a cylinder injection type internal combustion engine. More particularly, the present invention is concerned with a control scheme for preventing or suppressing degradation in accuracy of valve opening operation as well as fuel injection, which degradation may be brought about by external disturbances which will take place particularly when the fuel injection valve is driven with an overexcitation current at a battery voltage.

2. Description of Related Art

In recent years, the so-called cylinder injection type (or direct fuel injection type) internal combustion engine which is equipped with a fuel injection valve for injecting the fuel directly into the engine cylinder has been developed and employed increasingly in practical applications. In such cylinder injection type internal combustion engine, since the fuel is directly injected into the engine cylinder, the period during which the fuel can be injected into the cylinder is ordinarily limited at least to within a time period which extends from a suction stroke to a compression stroke of the engine. For this reason, the flow rate gain of the fuel injection valve (i.e., flow rate of the injected fuel relative to the width or duration of a driving pulse for driving the fuel injection valve) has to be increased when compared with the multi-point injection (MPI) type engine equipped with the fuel injection valves mounted in an intake pipe. In this conjunction, it is however noted that an attempt simply for increasing the flow rate gain of the fuel injection valve will incur increasing of the minimum fuel injection quantity, giving rise to a problem.

In this conjunction, it is known as an approach for improving the fuel cost performance of the engine to reduce the pumping loss of the internal combustion engine by realizing a lean stratified combustion (i.e., combustion of a lean fuel mixture in stratified state) by increasing the mass mixture ratio of the air to the fuel (i.e., air-fuel ratio) within the engine cylinder. In that case, it is necessary to decease the minimum fuel injection quantity when compared with the MPI-type internal combustion engine.

Under the circumstances, a driving system for the fuel injection valve has been proposed, as disclosed, for example, in Japanese Patent Publication No. 23100/1992. For having better understanding of the teachings of the present invention, description will first be made in some detail of the conventional fuel injection valve driving system known heretofore by reference to the drawings. FIG. 15 is a block diagram showing only schematically a configuration of a conventional fuel injection valve driving system for a cylinder injection type internal combustion engine. Referring to the figure, a fuel injection valve control means 4 is so designed as to actuate an overexcitation drive means 2 to thereby open a fuel injection valve 1 with a first driving current (referred to as the overexcitation current) supplied from a battery power source at a battery voltage. Subsequently, the fuel injection valve control means 4 actuates a holding drive means 3 to change over the driving current, i.e., the overexcitation current, to a second driving current (referred to as the holding current) which is smaller than the first driving current or the overexcitation current, the second driving current or the holding current being fed to the fuel injection valve 1 in order to hold the same in the opened state.

By adopting the driving current changeover scheme described above in the driving system for driving the fuel injection valve 1, the response performance or behavior of the fuel injection valve 1 can certainly be improved with the linearity of the fuel injection characteristic being maintained even in a low pulse-frequency region to an advantage, as is well.

Next, description will turn to the fuel injection control operation of the conventional injection valve driving system by reference to the timing chart shown in FIG. 16. In this timing chart, the individual signal waveforms depicted with solid lines represent the operation of the conventional fuel injection valve driving system in the state where the battery voltage is at V0 (see the top row (a)). The duration or width Pw0 of the driving pulse for the fuel injection valve 1 (see the row (b)) is determined as a sum of an effective pulse width or duration Te0 (equivalent to the effective driving time duration for the actual fuel injection) and a dead time Td0 (see the row (e)). Parenthetically, the dead time is defined as a time period which lapses until the lift operation of the fuel injection valve 1 is actually started from a time point when the driving pulse of the width Pw0 was applied.

In general, the dead time Td exhibits such a characteristic as a function of the battery voltage, as illustrated in FIG. 3. From this figure, the battery voltage-versus-dead time characteristic will be self-explanately. The battery voltage-versus-dead time characteristic is previously stored in a control unit (not shown) as table or map data with the battery voltage being selected as an index parameter. Accordingly, by referencing the map data, the dead time Td can be determined on the basis of the battery voltage.

The overexcitation drive means 2 starts the driving of the fuel injection valve 1 by supplying the overexcitation current thereto in synchronism with the leading edge of the driving pulse having the pulse width Pw0, to thereby allow the overexcitation current to flow through a plunger coil of the fuel injection valve 1 for a predetermined proper valve open time Tk0 (see the row (c) in FIG. 16). Upon termination of the overexcitation driving of the fuel injection valve by the overexcitation drive means 2, the holding drive means (also termed simply the holding means) 3 then supplies a holding current to the fuel injection valve 1 in continuation to the overexcitation driving current. The supply of the holding current by the holding drive means 3 is terminated in synchronism with the trailing edge of the driving pulse having the pulse width Pw0. This driving pulse itself will also be designated by Pw0 for convenience of the description.

As another fuel injection valve driving scheme, such system is also adopted in which the battery voltage is boosted by resorting to the use of a high-voltage power supply circuit for thereby feeding an overexcitation current to the fuel injection valve 1 in an attempt for realizing the valve opening operation with enhanced response performance so that the linearity of the fuel injection characteristic can be ensured even in a lower pulse frequency region, as is disclosed in Japanese Patent Application Laid-Open Publication No. 47140/1998 (JP-A-10-47140).

However, in the conventional driving system for driving the fuel injection valve by feeding thereto the overexcitation current at the battery voltage, as in the case of the electromagnetic fuel injector driving system disclosed in Japanese Patent Publication No. 23100/1992, no consideration is paid to the changes of the fuel flow characteristics brought about by disturbances such as influences of the change in the battery voltage applied to the fuel injection valve, change in the resistance of the plunger coil constituting a part of the electromagnetic fuel injector (hereinafter this resistance of the plunger coil will also be referred to as the coil resistance), change of the fuel pressure fed to the fuel injection valve and others. Consequently, the conventional fuel injection valve driving system actually adopted in the internal combustion engine suffers a serious problem that the fuel injection quantity can not be controlled to a desired value when the disturbances such as mentioned above make appearance.

By way of example, operations of the electromagnetic fuel injection valve driving system at the battery voltage lowered to a level V1 (<V0) are illustrated in FIG. 16 by dotted line curves. In this case, the duration or width Pw1 of the fuel injection valve driving pulse can be determined as a sum of the effective pulse width Te0 and the dead time Td1 (see the bottom row (e)) when the battery voltage is lowered to a voltage V1.

Incidentally, in the exemplary case illustrated in FIG. 16, the driving pulse duration is presumed to end at a time point t. Accordingly, the driving pulse having the pulse width Pw1 (see the top row (a)) for driving the fuel injection valve is applied at an earlier time point corresponding to the extension of the dead time period from Td0 to Td1.

In this conjunction, it is assumed that the overexcitation current is supplied to the fuel injection valve 1 over a time span Tk1 (see (c)) which is same as the time period Tk0 (also see (c)) when the battery voltage is at V0 notwithstanding the lowering of the battery voltage from the level V0 to V1. Then, the slope and the peak of the current flowing through the fuel injection valve 1 assume smaller values, respectively, when compared with the case where the battery voltage is at V0. See (c) in FIG. 16. As a consequence, magnitude of the attracting force of the plunger becomes lower, incurring dullness of the lifting operation of the fuel injection valve 1. Thus, degradation is involved in respect to the accuracy of the fuel quantity as injected. In the worst case, there may arise such situation that the fuel injection valve can not be opened. Parenthetically, the quantity of fuel injection substantially corresponds to the area (integrated value) of a curve representing the lifting operation of the fuel injection valve illustrated in FIG. 16 at the bottom row.

On the other hand, it is noted that the battery voltage detected by the battery voltage detecting means 5 is superposed with ripple components which make appearance in accompanying the electricity generation by a vehicle-onboard generator and switching noises of various electric loads. Accordingly,. if the overexcitation time duration and the dead time are set straightforwardly on the basis of the detected voltage intactly, the overexcitation time duration as well as the dead time duration will be set erroneously more or less due to the noise and ripple components superposed on the battery voltage as mentioned above, which will ultimately aggravate the deviation of the fuel injection quantity, giving rise to a serious problem.

Furthermore, when the coil temperatures of the fuel injection valve 1 rises with the coil resistance increasing to a value R1 (>R0), operations of the fuel injection valve driving system will become such as depicted by dotted lines in FIG. 17. The duration or width Pw0 of the pulse for driving the fuel injection valve 1 is determined as a sum of the effective pulse width Te0 and the dead time Td0 when the battery voltage is constant at the value V0. See FIG. 16 as well.

In this case, when the same overexcitation current as the one when the value of the coil resistance is R0 is fed to the fuel injection valve 1 over the overexcitation time duration Tk0, the amount of conducting current decreases, as a result of which the slope and the peak of the current flowing through the fuel injection valve 1 assume smaller values, respectively, as is depicted by the dotted lines in FIG. 17 when compared with the case where the coil resistance is R0. As a consequence, magnitude of the attracting force of the plunger becomes lower, incurring dullness or in accuracy of the lifting operation of the fuel injection valve 1. Thus, degradation will be involved in respect to the accuracy of the fuel quantity as injected. In the worst case, there may arise such situation that the fuel injection valve can not be opened.

Moreover, if the fuel pressure acting on the fuel injection valve 1 changes, balance between the attracting or pulling force for opening the fuel injection valve and the fuel pressure changes even when the attracting force exerted by the plunger coil is constant, bringing about corresponding change in the balanced state between the fuel pressure and the attraction or pulling force of the needle valve for opening the fuel injection valve, which in turn incurs degradation in the accuracy of the fuel quantity as injected.

On the other hand, in the case of the injection valve driving system which is so designed as to output the first driving current (overexcitation current) from a high-voltage power supply circuit at a high voltage, as disclosed in Japanese Patent Application Laid-Open Publication No. 47140/1998, degradation with regard to the accuracy of the fuel quantity injected brought about under the influence of the disturbances such as mentioned above is less serious when compared with the system in which the overexcitation current is outputted at the battery voltage. However, there still exists a problem that the electric circuit is expensive because of necessity for use of the high-voltage power supply circuit which is very expensive.

SUMMARY OF THE INVENTION

In the light of the state of the art described above, it is an object of the present invention to solve the problems of the conventional fuel injection control system described above and provides an improved fuel injection control system for a cylinder injection type internal combustion engine, which system can constantly ensure reliable valve opening operation and can control the fuel injection quantity to a desired value with high accuracy by driving the fuel injection valve with an overexcitation current at a battery voltage while carrying out appropriate correction control for disposing of the disturbances.

In view of the above and other objects which will become more apparent as the description proceeds, there is provided according to a general aspect of the present invention a fuel injection control system for a cylinder injection type internal combustion engine, which system includes an electromagnetic-type fuel injection valve for injecting fuel directly into an engine cylinder, an overexcitation drive means for outputting an overexcitation current for opening the fuel injection valve from a vehicle-onboard power supply unit mounted on a motor vehicle equipped with the cylinder injection type internal combustion engine to the fuel injection valve during a predetermined overexcitation time duration conforming to a power supply voltage of the power supply unit, a holding drive means for outputting a holding current smaller than the overexcitation current from the vehicle-onboard power supply unit to the fuel injection valve for holding the fuel injection valve in a valve open state, a fuel injection valve control means for changing over output operation of the overexcitation drive means with output operation of the holding drive means to thereby control driving operation for the fuel injection valve, a voltage detecting means for detecting the output voltage of the power supply unit, and a switching time-point change means for changing a time point for switching the output operation of the overexcitation drive means to the output operation of the holding drive means for the fuel injection valve control means in dependence on the voltage detected by the voltage detecting means.

In a preferred mode for carrying out the present invention, the switching time-point change means may be so designed that when the voltage of the power supply unit detected in the course of outputting the overexcitation current becomes lower than the voltage on the basis of which the currently validated overexcitation time duration has been determined, the switching time-point change means sets again the currently validated overexcitation time duration in dependence on the detected voltage, to thereby change correspondingly the time point for switching the output operation of the overexcitation drive means to the output operation of the holding drive means.

In another preferred mode for carrying out the present invention, the fuel injection control system for a cylinder injection type internal combustion engine may further include an averaging means for averaging the detected voltage detected by the voltage detecting means, wherein the switching time-point change means may be so designed as to change correspondingly the time point for switching the output operation of the overexcitation drive means to the output operation of the holding drive means in dependence on an averaged voltage determined by the averaging means.

According to another aspect of the present invention, there is provided a fuel injection control system for a cylinder injection type internal combustion engine, which system includes an electromagnetic-type fuel injection valve for injecting fuel directly into an engine cylinder, an overexcitation drive means for outputting an overexcitation current for opening the fuel injection valve from a vehicle-onboard power supply unit mounted on a motor vehicle equipped with the cylinder injection type internal combustion engine to the fuel injection valve during a predetermined overexcitation time duration which conforms to a power supply voltage of the power supply unit, a holding drive means for outputting a holding current smaller than the overexcitation current from the vehicle-onboard power supply unit to the fuel injection valve for holding the fuel injection valve in a valve open state, a fuel injection valve control means for changing over output operation of the overexcitation drive means with output operation of the holding drive means to thereby control driving operation for the fuel injection valve, a coil resistance detecting means for estimating a value correlating to a coil resistance of the fuel injection valve, and a first correcting means for correcting a time point for switching the output operation of the overexcitation drive means to the output operation of the holding drive means for the fuel injection valve control means in dependence on the estimated coil resistance value outputted from the coil resistance detecting means.

In still another preferred mode for carrying out the present invention, the fuel injection control system for a cylinder injection type internal combustion engine may further include a first dead time change means for changing a dead time of the fuel injection valve in accordance with estimated coil resistance value outputted from the coil resistance detecting means.

In a further preferred mode for carrying out the present invention, the fuel injection control system for a cylinder injection type internal combustion engine may further include a fuel pressure detecting means for detecting a fuel pressure acting on the fuel injection valve, a second correcting means for correcting a time point for changing over the output operation of the overexcitation drive means to the output operation of the holding drive means for the fuel injection valve control means in dependence on the fuel pressure outputted from the fuel pressure detecting means, and a second dead time change means for changing the dead time of the fuel injection valve in accordance with detected fuel pressure outputted from the fuel pressure detecting means.

By virtue of the above-mentioned arrangements of the fuel injection control system for the cylinder injection type internal combustion engine in which the fuel injection valve undergoes the overexcitation driving at the battery voltage, the fuel injection quantity can be corrected properly or appropriately against disturbances by correcting the overexcitation time duration in dependence on the change of the battery voltage, correcting the overexcitation time duration in dependence on the change of the resistance of a coil plunger of the fuel injection valve, while correcting the overexcitation duration and the dead time in dependence on the change of the fuel pressure acting on the fuel injection valve, whereby stable valve opening operation as well as the fuel injection accuracy can be ensured.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
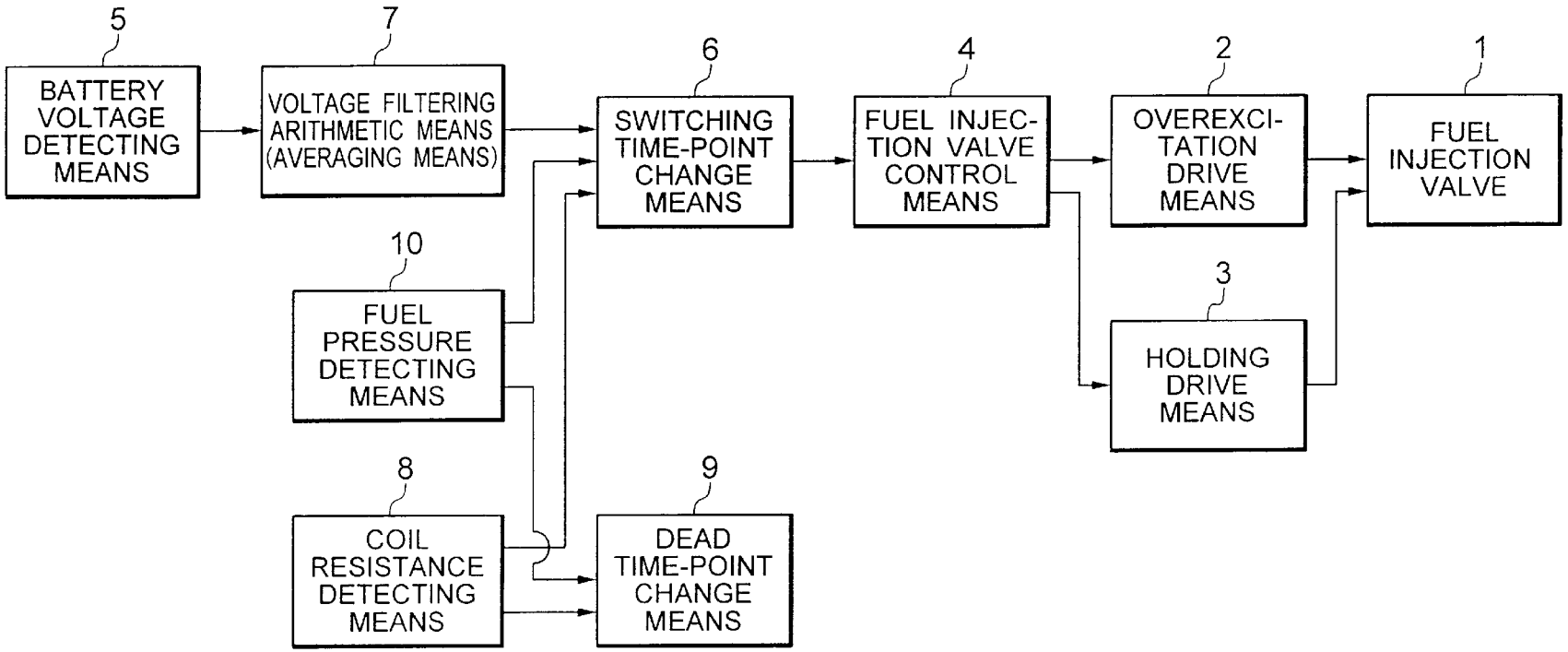
FIG. 1 is a schematic block diagram showing a system configuration of a fuel injection control system for a cylinder injection type internal combustion engine which the present invention concerns.

The present invention will be described in detail in conjunction with what is presently considered as preferred or typical embodiments thereof by reference to the drawings. In the following description, like reference characters designate like or corresponding parts throughout the several views.

Embodiment 1

FIG. 1 is a system block diagram showing a basic configuration of the fuel injection control system for a cylinder injection type internal combustion engine according to an embodiment of the present invention. Incidentally, in FIG. 1, reference symbols like as those used in FIG. 15 denote same or equivalent components.

Now, referring to FIG. 1, the fuel injection control system is comprised of a fuel injection valve 1 for injecting the fuel directly into an engine cylinder, an overexcitation drive means 2 for supplying a voltage from a battery mounted on a motor vehicle (both not shown) or a voltage available from a vehicle-onboard electricity generator to a fuel injection valve 1 for thereby opening the fuel injection valve 1 through energization with an overexcitation current, a holding drive means 3 for outputting a holding current for holding the fuel injection valve 1 in the valve open state under the voltage applied from the vehicle-onboard battery or vehicle-onboard electricity, generator, a fuel injection valve control means 4 for controlling a driving current for the fuel injection valve 1 by changing over the output operation of the overexcitation drive means 2 with that of the holding drive means 3, a battery voltage detecting means 5 for detecting the voltage of the battery, a switching time-point change means 6 for changing or altering the time point for changing over the output operation of the overexcitation drive means 2 and that of the holding drive means 3 to each other, and a voltage filtering arithmetic means 7 for smoothing or averaging the voltage detected by the battery voltage detecting means 5.

Further, the fuel injection control system according to the instant embodiment of the present invention is equipped with a fuel pressure detecting means 10 for detecting the hydraulic pressure of the fuel to be charged into the fuel injection valve 1 under pressure, a coil resistance detecting means 8 for detecting the resistance of a plunger coil which constitutes a part of the fuel injection valve 1, and a dead time change means 9 for altering or changing the dead time on the basis of the result of the detection of the coil resistance or the result of the detection of the fuel pressure. Incidentally, operations of the coil resistance detecting means 8, the dead time change means 9 and the fuel pressure detecting means 10 will be described later on in due course in conjunction with operations of the fuel injection control system according to other embodiments of the invention.

Next, operation of the fuel injection control system according to the first embodiment of the invention will be described by paying attention to the result of detection of the battery voltage among others.

Figure 3:
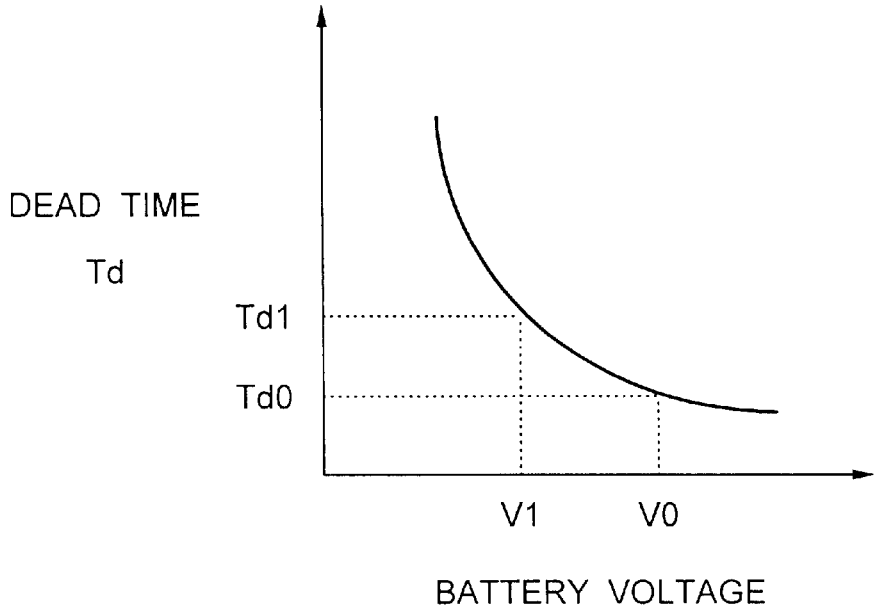
FIG. 3 is a view for graphically illustrating a characteristic relation between the battery voltage and a dead time.
Figure 4:
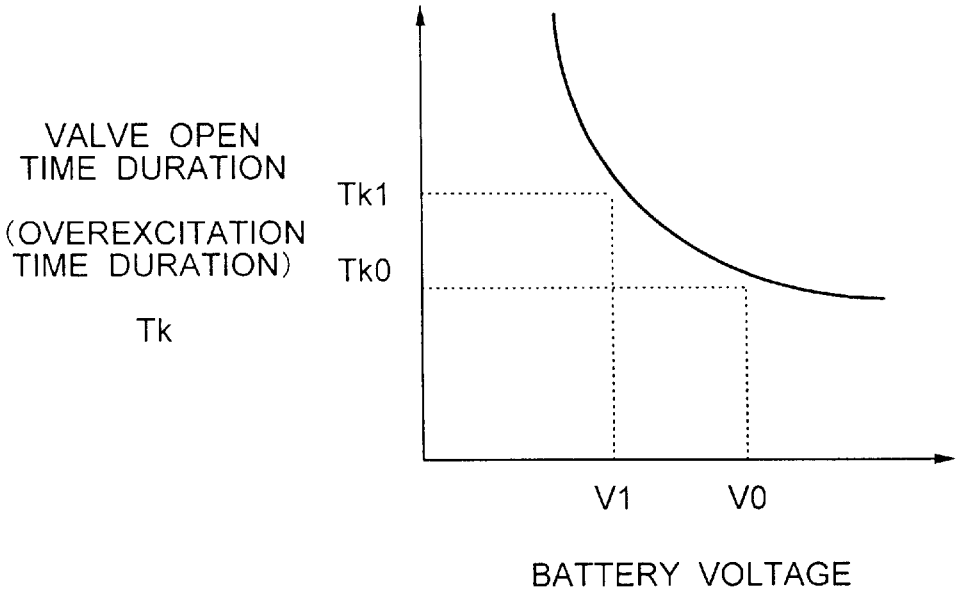
FIG. 4 is a view for graphically illustrating a characteristic relation between the battery voltage and an overexcitation time duration.

FIG. 4 is a view for graphically illustrating a characteristic relation between the battery voltage and the valve open time duration (overexcitation time duration) of the fuel injection valve, i.e., battery voltage-versus-overexcitation characteristic, to say in another way. According to the teachings of the present invention incarnated in the instant embodiment thereof, the relation between the battery voltage and the dead time such as illustrated in FIG. 3 and the relation between the battery voltage and the valve open time duration such as illustrated in FIG. 4 are made use of in carrying out the correction control of the dead time and the overexcitation time duration as a function of variation in the battery voltage. More specifically, the overexcitation time duration is once selected so as to correspond to an appropriate valve open time duration shown in FIG. 4, whereon the overexcitation time duration is changed correspondingly in dependence on the battery voltage as detected to thereby ensure positively and accurately the valve opening operation of the fuel injection valve 1.

At first, fuel injection control operation performed by the fuel injection control system according to the instant embodiment of the invention will be described by reference to a timing chart shown in FIG. 2.

Figure 2:
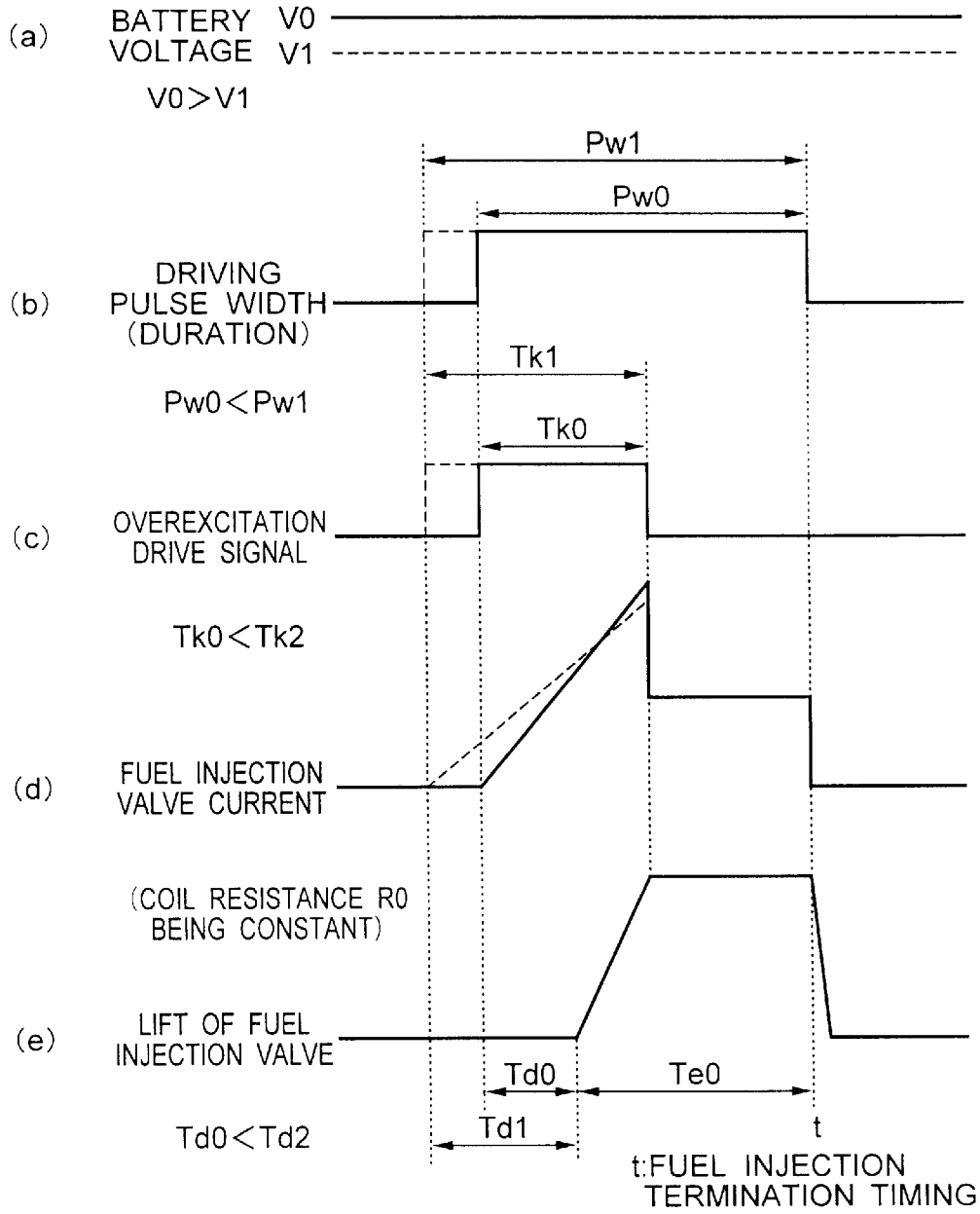
FIG. 2 is a timing chart for illustrating fuel injecting operation upon change of a battery voltage in a fuel injection control system according to a first embodiment of the present invention.

Referring to FIG. 2, solid line curves represent same operations as those described hereinbefore in conjunction with the conventional technique at the battery voltage V0 ((a), FIG. 2). The description which follows will be directed to the operations when the battery voltage is lowered to a level V1 (<V0) (see FIG. 2, top row (a)). When the battery voltage has been lowered to the level V1, operations represented by broken line curves or segment shown in FIG. 2 are effectuated. The duration or width Pw1 of the driving pulse for the fuel injection valve 1 can be determined similarly to the conventional scheme as a sum of the effective pulse width Te0 and the dead time Td1 in the state where the battery voltage has been lowered to the voltage V1 (see FIG. 3). Incidentally, the driving pulse width Pw1 is presumed to end at a time point t. Accordingly, the driving pulse having the pulse width Pw1 for driving the fuel injection valve is applied at an earlier time point corresponding to the extension of the dead time period from Td0 to Td1.

Further, the overexcitation time duration Tk1 (>Tk0) for the battery voltage of V1 (see (c) in FIG. 2) is arithmetically determined by referencing the relevant map data (see FIG. 4). As a result of this, the overexcitation current supply time duration increases. In that case, the slope and the peak value of the current flowing through the plunger coil of the fuel injection valve 1 will certainly become lower when compared with the state in which the battery voltage is V0, as illustrated in FIG. 2 at (d) by the broken line. However, it should be noted that as to the lifting operation of the fuel injection valve, the battery voltage is substantially similar to the battery voltage of V0, whereby the valve opening operation can positively be ensured regardless of lowering of the battery voltage and thus the injection of the fuel quantity substantially same as the one in the state where the battery voltage is normal (V0) can be realized.

Figure 5:
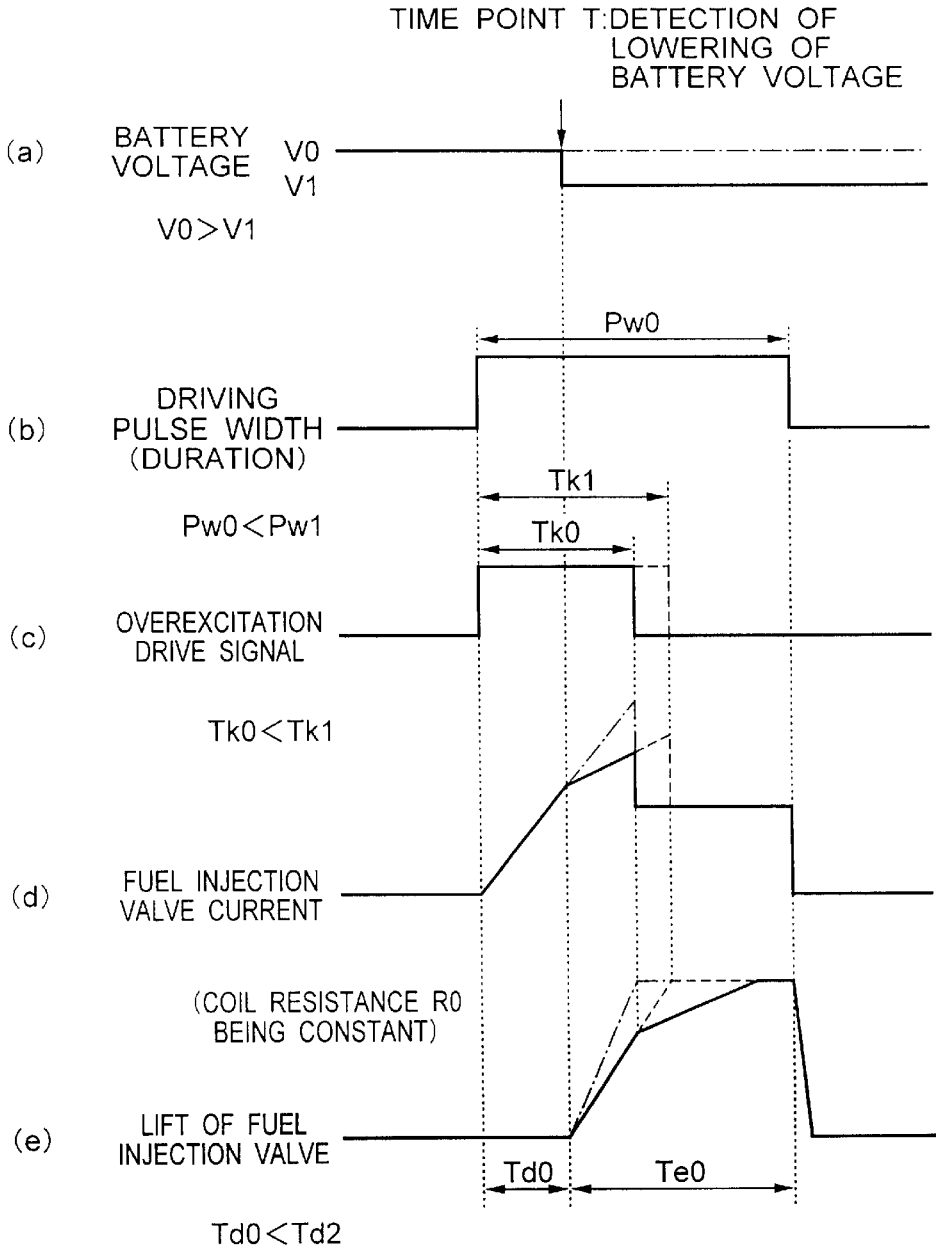
FIG. 5 is a timing chart for illustrating fuel injecting operation upon change of a battery voltage in the course of overexcitation of the fuel injection valve in the fuel injection control system according to the first embodiment of the invention.

Next, referring to the time chart shown in FIG. 5, description will be directed to the operation of the fuel injection control system when the battery voltage becomes lower in the course of driving the fuel injection valve with the overexcitation current.

When the battery voltage is constant at V0, the current of the fuel injection valve 1 rises as represented by a solid broken line, as is illustrated in FIG. 5 at (d). Thus, the lift of the fuel injection valve changes as indicated by a solid line curve at (e) in FIG. 5. However, when the battery voltage drops from the level V0 to V1 at a time point T as indicated by a solid line curve at (a) in FIG. 5, the slope of the current flowing through the plunger coil of the fuel injection valve will become small as indicated by a solid line curve at (d) in FIG. 5, with the lifting speed of the fuel injection valve becoming slower, as indicated by a solid line at (e) in FIG. 5, as a result of which the valve open timing is retarded.

With a view to coping with the situation described above, the fuel injection control system according to the instant embodiment of the present invention is so arranged such that when the lowering of the battery voltage from VO to V1 is detected in the course of driving the fuel injection valve with the overexcitation current, the overexcitation time duration is changed from the duration Tk0 to the duration Tk1 as indicated by a broken line at (c) in FIG. 5. As a result of this, the current flowing through the fuel injection valve increases at a predetermined slope up to a time point the overexcitation driving current signal falls, whereby the current flowing through the plunger coil of the fuel injection valve can reach a greater peak value. At the same time, the change rate of the lift of the fuel injection valve is protected against attenuation without becoming lower on the way, as is illustrated at (e) in FIG. 5. Thus, the lift of the fuel injection valve can increase (also see FIG. 5, (e)). In this way, the fuel injection valve opening operation can be carried out with high accuracy and reliability in conformance with change or variation in the battery voltage while avoiding the adverse influence thereof.

By the way, when lowering of the battery voltage is detected during the overexcitation driving of the fuel injection valve (in the course of executing the fuel injection cycle), it is preferred to recheck the overexcitation end timing by taking into consideration the battery voltage to thereby regulate properly the overexcitation end timing even during the overexcitation driving of the fuel injection valve in order to ensure at least the valve opening duration with accuracy and reliability.

In the fuel injection control system according to the instant embodiment of the present invention, the voltage filtering arithmetic means 7 is provided for smoothing or averaging the battery voltage detected by the battery voltage detecting means 5, wherein the switching time-point change means 6 is so designed as to alter or change the time point for changing over or switching the output operation between the overexcitation drive means 2 and the holding drive means 3 on the basis of the mean voltage signal derived from the processing of the voltage filtering arithmetic means 7. By using the detected battery voltage averaged or smoothed as mentioned above, transient voltage lowering due to the ripple components of the output of the onboard generator and switching noise of electric loads as superposed on the power supply voltage can be avoided from being detected erroneously as the lowering or rising of the battery voltage.

Thus, the dead time as well as the overexcitation time duration can be corrected in consideration of the change of the battery voltage while avoiding the disturbances.

Figure 12:
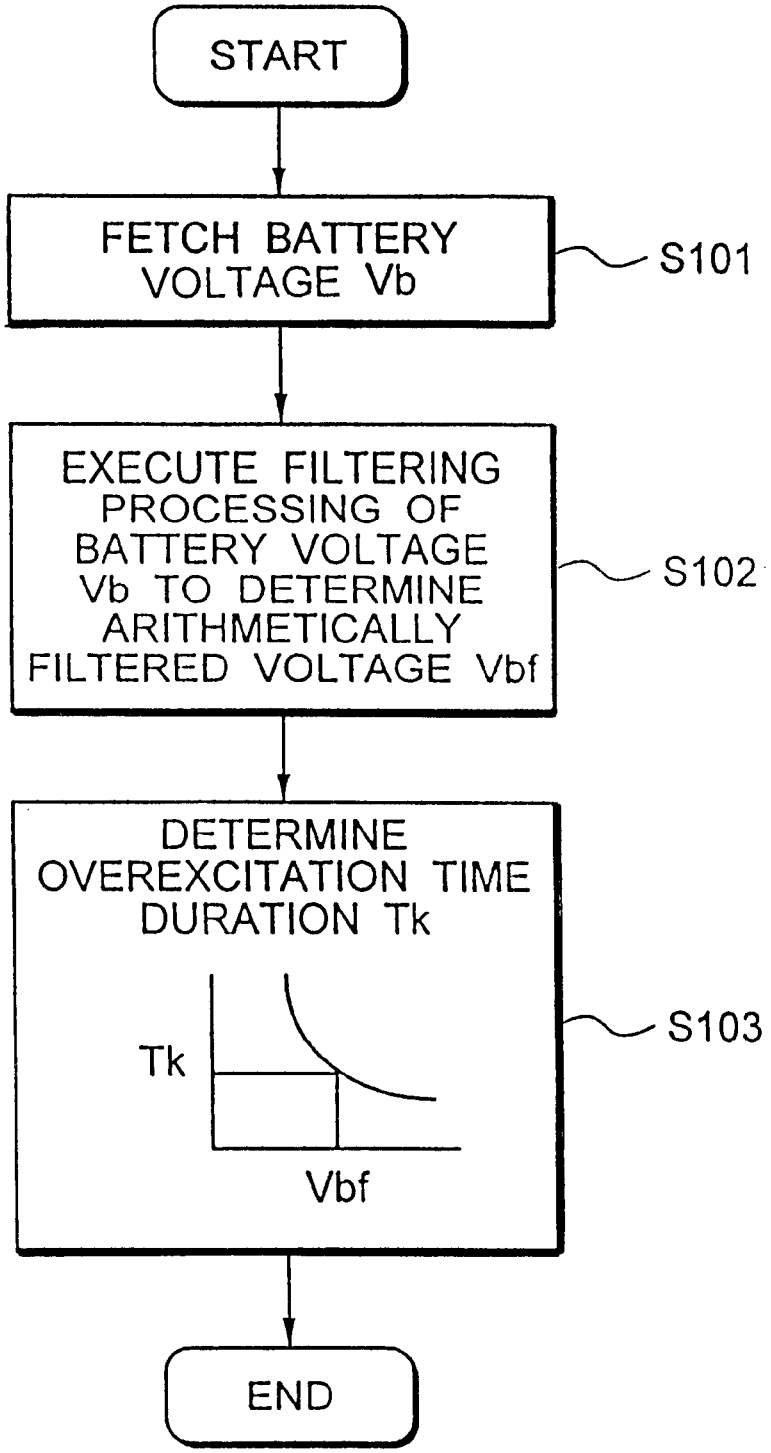
FIG. 12 is a flow chart for illustrating a fuel injection control procedure executed upon change of the battery voltage in the fuel injection control system according to the first embodiment of the invention.

Next, operation of the fuel injection control system now concerned will be described by reference to the flow chart shown in FIG. 12.

At first, the battery voltage Vb detected by the battery voltage detecting means 5 is fetched in a step S101.

Subsequently, in a step S102, the battery voltage Vb fetched in the step S101 undergoes filtering processing to whereby the smoothed or filtered (averaged) voltage Vbf is derived. Parenthetically, as a method of filtering processing, there can be mentioned a method of determining a weighted mean value or a running mean value of the values of the battery voltage Vb detected a predetermined number of times or a linear filtering method. However, since the filtering method or means itself does play no important role in the fuel injection control system according to the invention, i.e., since the conventional filtering means known per se can be employed in the fuel injection control system according to the present invention, any further description in detail of the filtering method will be unnecessary.

In succession, the processing proceeds to a step S103 where the overexcitation time duration Tk corresponding to the filtered voltage Vbf is determined by referencing the battery voltage-versus-overexcitation time duration map data mentioned hereinbefore, whereupon the processing comes to an end.

Thereafter, the fuel injection valve is driven with the overexcitation time duration Tk determined in the step S103. In this manner, the lifting operation of the fuel injection valve 1 can be so realized that the fuel injection quantity of a same flow rate can be injected into the engine cylinder regardless of the battery voltage which may contain noise components.

Embodiment 2

In the following, the fuel injection control operation of the fuel injection control system for the cylinder injection type engine according to a second embodiment of the present invention will be described by reference to the drawings. Parenthetically, the configuration of the fuel injection control system according to the instant embodiment of the invention is substantially same as that of the fuel injection control system shown in FIG. 1.

Figure 8:
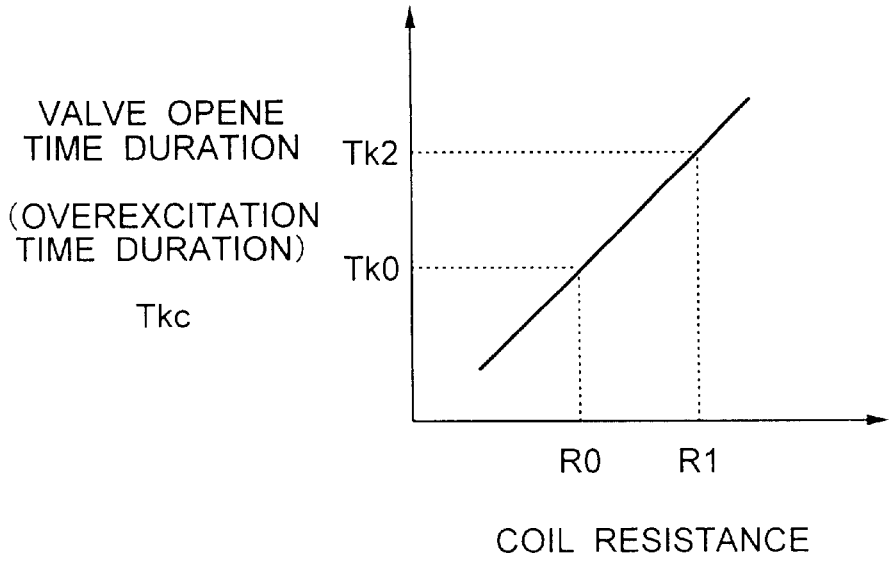
FIG. 8 is a view for graphically illustrating a characteristic relation between the coil resistance and the overexcitation time duration.

FIG. 8 is a view for graphically illustrating a characteristic relation between change of a coil resistance due to variation of the temperature of the fuel injection valve 1 and change of the valve open time, i.e., coil resistance-versus-valve open time characteristic. According to the teachings of the present invention incarnated in the instant embodiment, the relations between the coil resistance and the valve open time duration as illustrated in FIG. 8 is referenced for realizing the correction control of the overexcitation time duration.

More specifically, the overexcitation time duration is once selected as the proper or appropriate valve open time duration by referencing the map data illustrated shown in FIG. 8, whereon the overexcitation time duration is changed correspondingly in dependence on the change of the coil resistance as detected, to thereby ensure positively the valve opening operation of the fuel injection valve 1.

Figure 7:
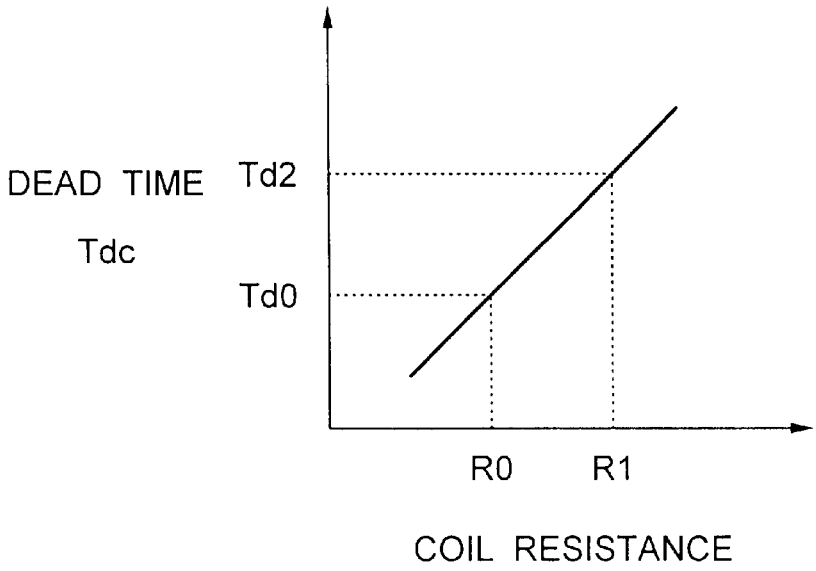
FIG. 7 is a view for graphically illustrating a characteristic relation between the coil resistance and the dead time.

Further, FIG. 7 is a view for graphically illustrating a characteristic relation between change of the coil resistance due to variation of temperature of the fuel injection valve 1 and the dead time. According to the teachings of the present invention incarnated in the instant embodiment, the relations between the coil resistance and the dead time as illustrated in this figure provides the basis for realizing the correction control of the dead time. More specifically, the dead time is arithmetically determined by referencing the map data illustrated in FIG. 7, whereon the dead time is changed correspondingly in dependence on and in conformance with the coil resistance as detected, for thereby ensuring accuracy and reliability for the valve opening operation of the fuel injection valve 1.

In this conjunction, as the method of detecting the coil resistance, there are known in general a method of determining the coil resistance by detecting the current flowing into the fuel injection valve 1 by means of a current detection circuit and then dividing the voltage applied across the fuel injection valve 1 by the detected current, a method of estimating the coil resistance in terms of temperature on the basis of the temperature information of the engine which exerts the influence to the coil resistance.

Next, the fuel injection control operation of the fuel injection control system according to the instant embodiment of the invention will be described by reference to a timing chart shown in FIG. 6.

Figure 6:
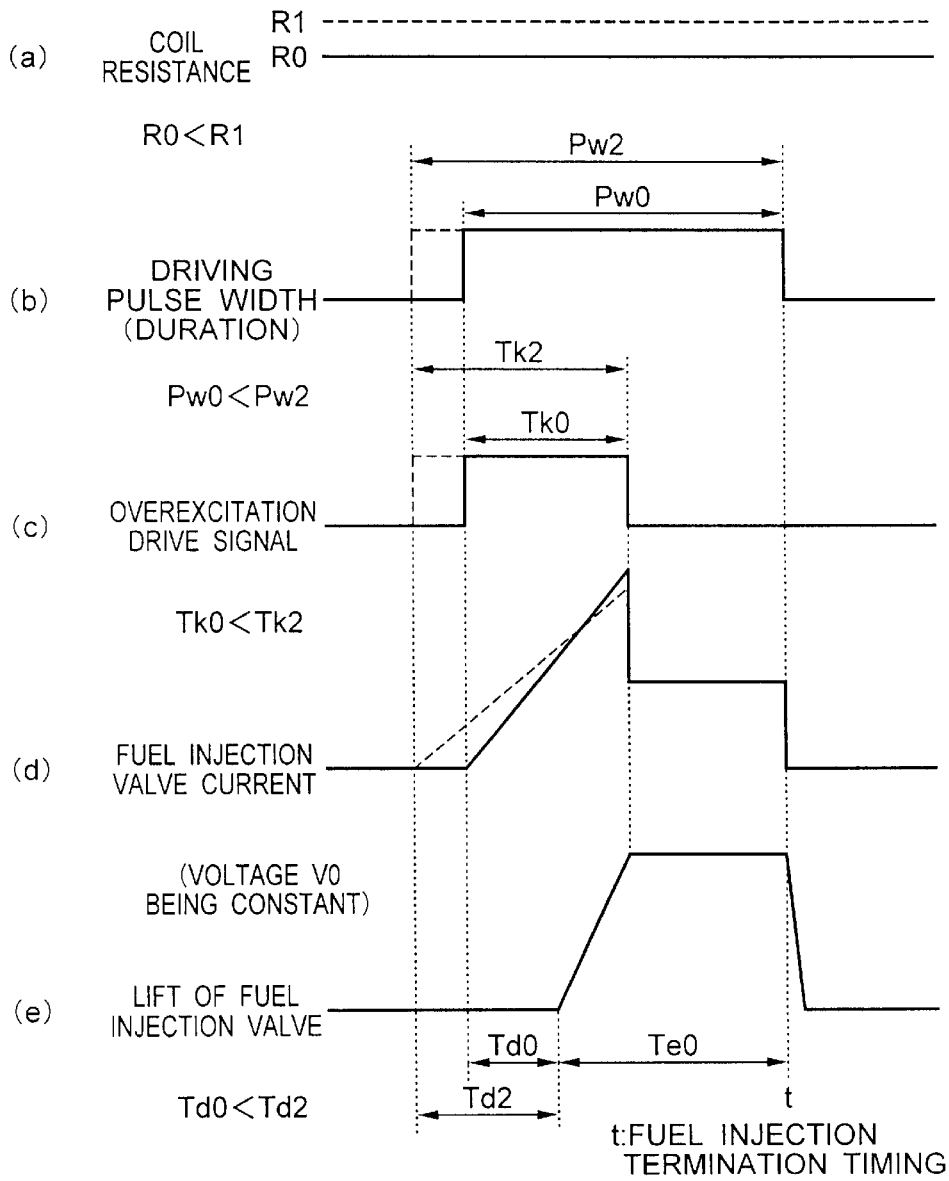
FIG. 6 is a timing chart for illustrating fuel injecting operation upon change of resistance of a coil plunger of the fuel injection valve in a fuel injection control system according to a second embodiment of the present invention.

Referring to FIG. 6, solid lines represent the same operations as those when the coil resistance is R0, as described hereinbefore in conjunction with the conventional fuel injection control system. Accordingly, repeated description of these operations is omitted and the following description will be directed to the operations performed when the coil resistance increases to a value R1 (>R0) (see FIG. 6, top row (a)). When the coil resistance has increased to the value R1, operations represented by broken line curves or segments shown in FIG. 6 are effectuated. The duration or width Pw2 of the driving pulse of the fuel injection valve 1 can be determined as a sum of the effective pulse width Te0 and the dead time Td2 when the coil resistance has increased to the value R1 (see FIG. 7). Parenthetically, the driving pulse width Pw2 is presumed to end at a time point t. Accordingly, the driving pulse having the pulse width Pw2 for driving the fuel injection valve is applied at an appropriate earlier time point corresponding to the extension of the dead time duration from Td0 to Td2.

Further, the overexcitation time duration Tk2 validated when the coil resistance is R1 is arithmetically determined, by referencing the map data shown in FIG. 8. When the overexcitation current is supplied, both the slope and the peak value of the current flowing through the fuel injection valve 1 certainly become lower when compared with the state in which the coil resistance is R0, as illustrated in FIG. 6 by the broken line at (d). Nevertheless, the lifting operation of the fuel injection valve is substantially similar to that when the coil resistance is R0, whereby the reliability and accuracy of the valve opening operation can be ensured. In this manner, the valve opening operation as well as the desired fuel injection quantity can be ensured.

Figure 13:
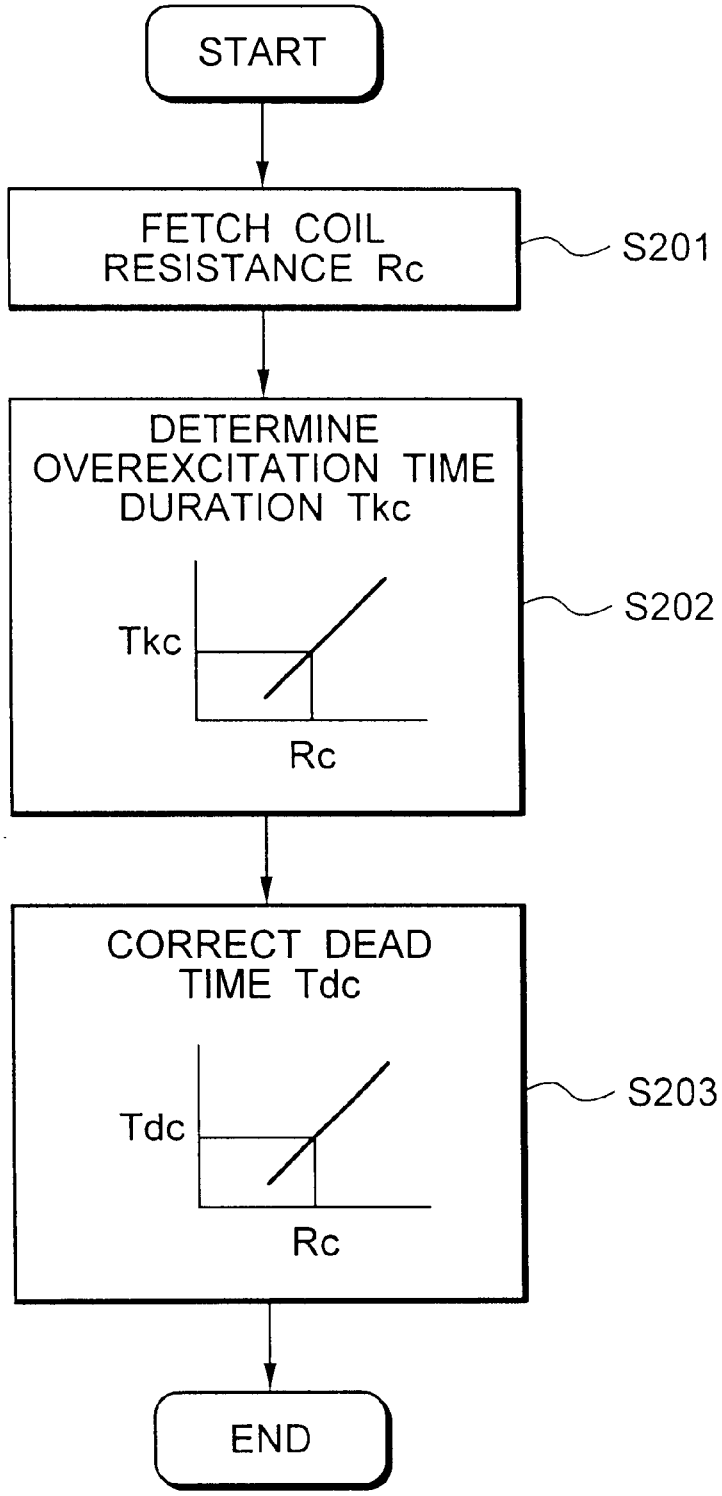
FIG. 13 is a timing chart for illustrating a fuel injection control procedure executed by upon change of the coil resistance in the fuel injection control system according to the second embodiment of the invention.

Next, operation of the fuel injection control system now concerned will be described by reference to the flow chart shown in FIG. 13.

At first, the coil resistance Rc detected by the coil resistance detecting means 8 is fetched in a step S201.

In succession, the processing proceeds to a step S202. In this step, the overexcitation time duration Tkc corresponding to the detected coil resistance Rc is arithmetically determined by referencing the map data illustrated in FIG. 8, whereon in a step S203, the dead time Tdc corresponding to the detected coil resistance Rc is determined by referencing the coil resistance-versus-dead time map data illustrated in FIG. 7. The processing then comes to an end.

Thereafter, the fuel injection valve 1 is driven with the overexcitation time duration Tkc determined in the step S202 while being driven with the dead time Tdc determined in the step S203. In this manner, the lifting operation of the fuel injection valve 1 can be so realized that the fuel injection quantity of a same flow rate can be injected into the engine cylinder notwithstanding of the change of the coil resistance.

Embodiment 3

In the following, the fuel injection control operation of the fuel injection control system for the cylinder injection type internal combustion engine according to a third embodiment of the present invention will be described by reference to the drawings. Parenthetically, the configuration of the fuel injection control system according to the instant embodiment of the invention is substantially same as that of the fuel injection control system shown in FIG. 1.

Figure 10:
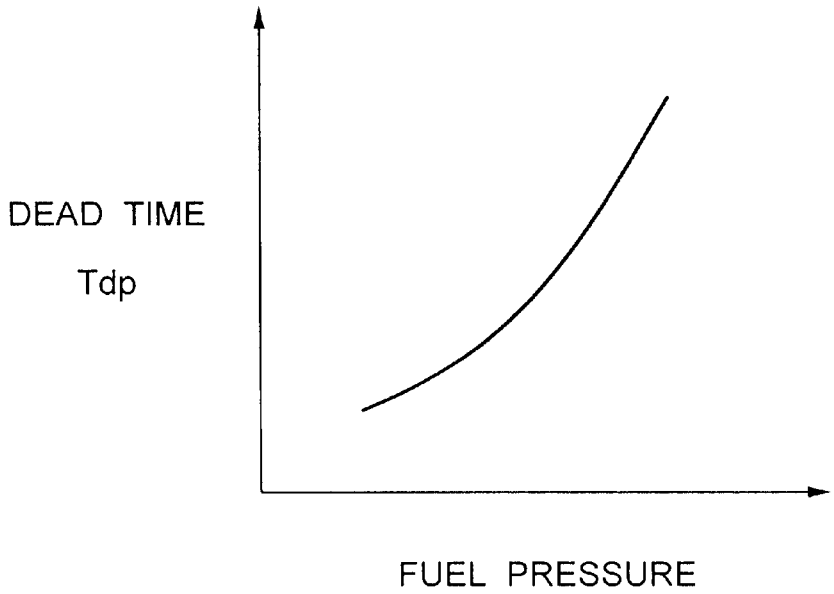
FIG. 10 is a view for graphically illustrating a characteristic relation between a fuel pressure acting on a fuel injection valve and the dead time.
Figure 11:
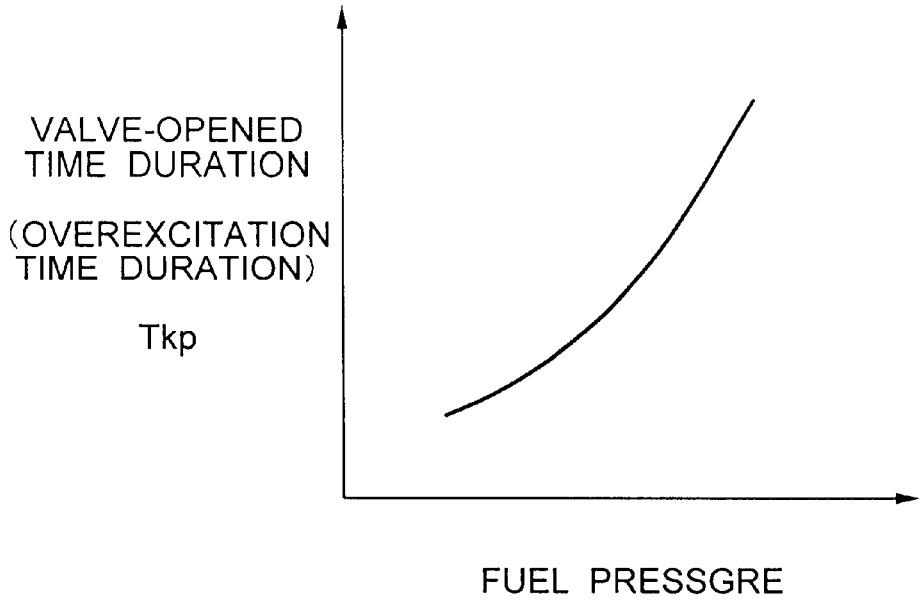
FIG. 11 is a view for graphically illustrating a characteristic relation between the fuel pressure acting on the fuel injection valve and the overexcitation time duration.

The dead time of the fuel injection valve 1 bears such relation to the fuel pressure as illustrated in FIG. 10 while the overexcitation time duration (valve open time duration) exhibits such relation to the fuel pressure as illustrated in FIG. 11. Accordingly, by storing the characteristics illustrated in FIGS. 10 and 11 as the map data similarly to the cases of the change of the battery voltage and that of the coil resistance, it is possible to realize the valve opening operation as well as the fuel injection with high accuracy and enhanced reliability by setting the dead time and the overexcitation time duration in dependence on the fuel pressure detected by the fuel pressure detecting means 10.

Next, the fuel injection control operation carried out by the fuel injection control system according to the instant embodiment of the invention will be described by reference to a timing chart shown in FIG. 9.

Figure 9:
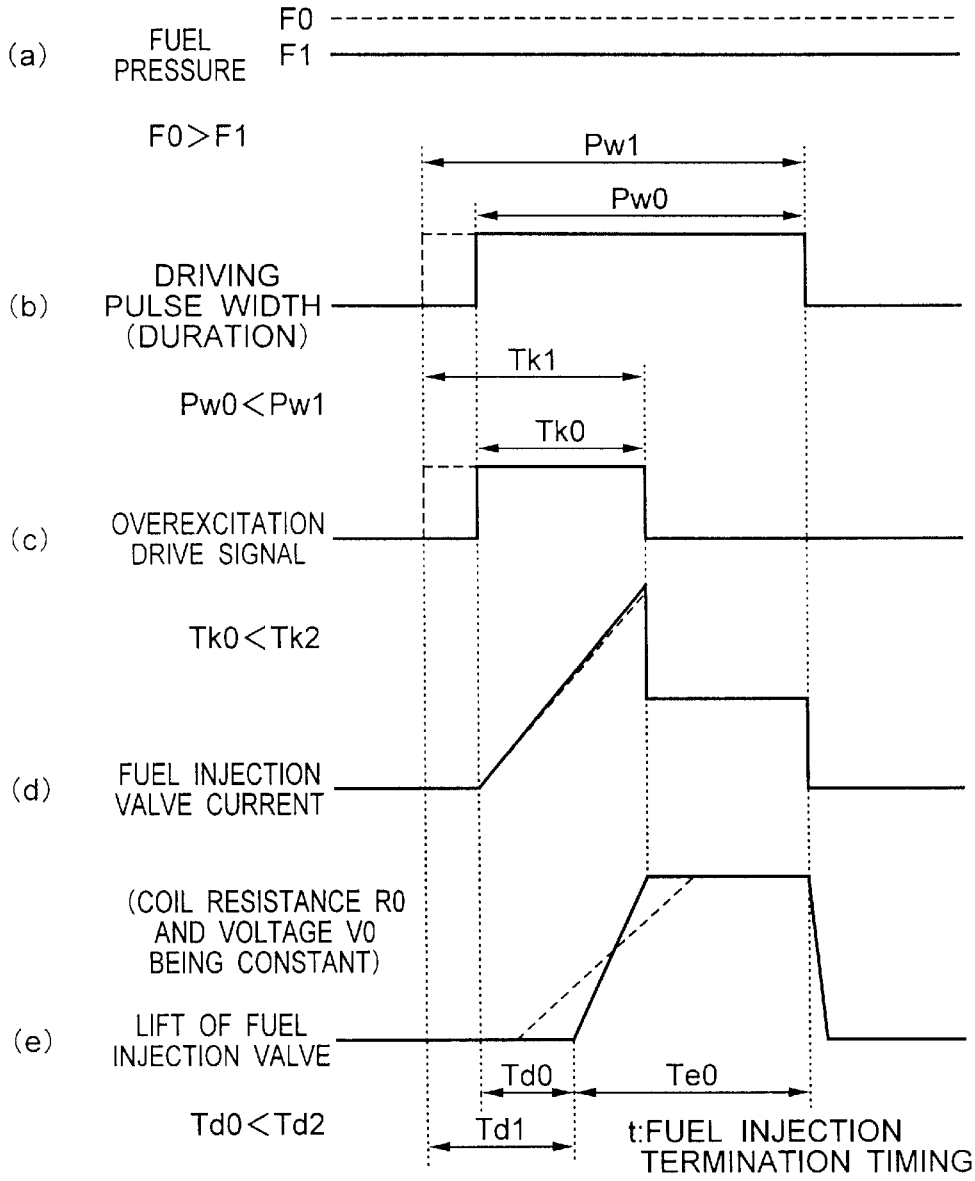
FIG. 9 is a timing chart for illustrating fuel injecting operation upon change of fuel pressure in a fuel injection control system according to a third embodiment of the present invention.

Referring to FIG. 9, the description will be directed to the operations when the fuel pressure increases to a level F0 (>F1) (see FIG. 9, top row (a)).

When the fuel pressure increases to the level F0 (FIG. 9, (a)), operations represented by broken line curves or segments shown in FIG. 9 are effectuated. The duration or width Pw1 of the driving pulse of the fuel injection valve 1 can be determined as a sum of the effective pulse width Te0 and the dead time Td1 (see bottom row (e) in FIG. 9) when the fuel pressure has increased to the level F0 (also see FIG. 10). Parenthetically, the driving pulse width Pw1 is presumed to end at a time point t. Accordingly, the driving pulse having the pulse width Pw1 for driving the fuel injection valve is applied at an earlier time point corresponding to the elongation of the dead time period from Td0 to Td1.

Further, the overexcitation time duration Tk1 when the fuel pressure is F0 is arithmetically determined by referencing the map data (illustrated in FIG. 11), and the overexcitation current is supplied. Then, both the slope and the peak value of the current flowing through the plunger coil of the fuel injection valve are substantially same when compared with the case where the fuel pressure is F1, as indicated by broken lines in FIG. 9. Consequently, although the lifting operation is accompanied with retarded response more or less, the lifting operation is started at an earlier time point (see (e) in FIG. 9). Thus, the fuel injection quantity is substantially same as the case where the fuel pressure is F1.

Figure 14:
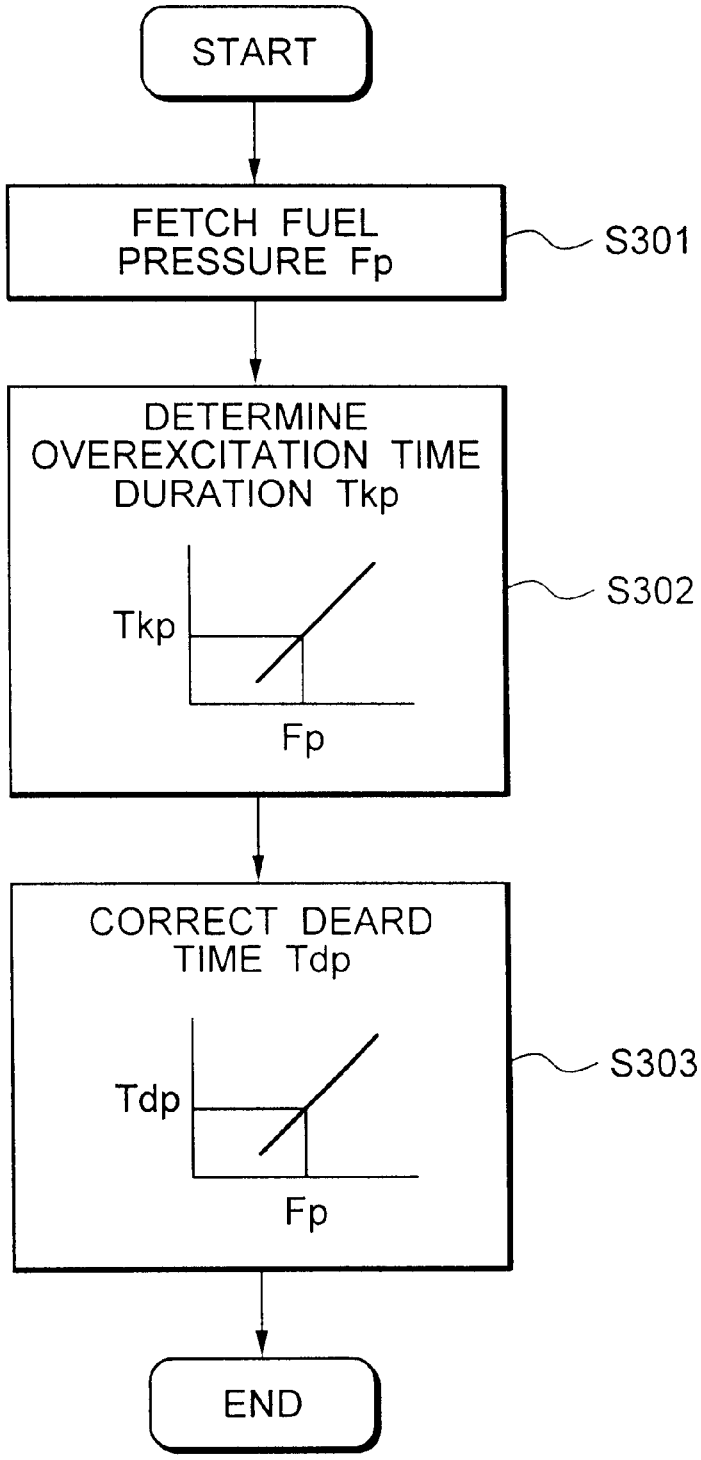
FIG. 14 is a timing chart for illustrating a fuel injection control procedure executed upon change of the fuel pressure in the fuel injection control system according to the third embodiment of the invention.

Next, operation of the fuel injection control system now under consideration will be described by reference to the flow chart shown in FIG. 14.

At first, the fuel pressure Fp detected by the fuel pressure detecting means 10 is fetched in a step S301.

In succession, the processing proceeds to a step S302 where an overexcitation time duration Tkp corresponding to the detected fuel pressure Fp is arithmetically determined by referencing the map data illustrated in FIG. 11, whereon in a step S303, the dead time Tdp corresponding to the detected fuel pressure Fp is determined by referencing the fuel pressure-versus-dead time map data illustrated in FIG. 10, whereupon the processing comes to an end.

Thereafter, the fuel injection valve 1 is driven with the overexcitation time duration Tkp determined in the step S302 while being accompanied with the dead time Tdp determined in the step S303. In this manner, the fuel injection quantity of the fuel injection valve 1 can be so realized that the fuel injection quantity of a same flow rate can be injected into the engine cylinder regardless of change of the fuel pressure.

In the embodiments of the present invention described in the foregoing, the overexcitation time duration or the dead time may be modified or changed on the basis of a combination of the detected changes of the power supply voltage and that of the fuel pressure, respectively.

Further, the overexcitation time duration or the dead time may be modified or changed on the basis of a combination of the detected change of the coil resistance and the fuel pressure, respectively.

Furthermore, the overexcitation time duration or the dead time may be modified or changed on the basis of a combination of the detected changes of power supply voltage, the coil resistance and the fuel pressure, respectively.

Many features and advantages of the present invention are apparent from the detailed description and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described.

Figure 15:
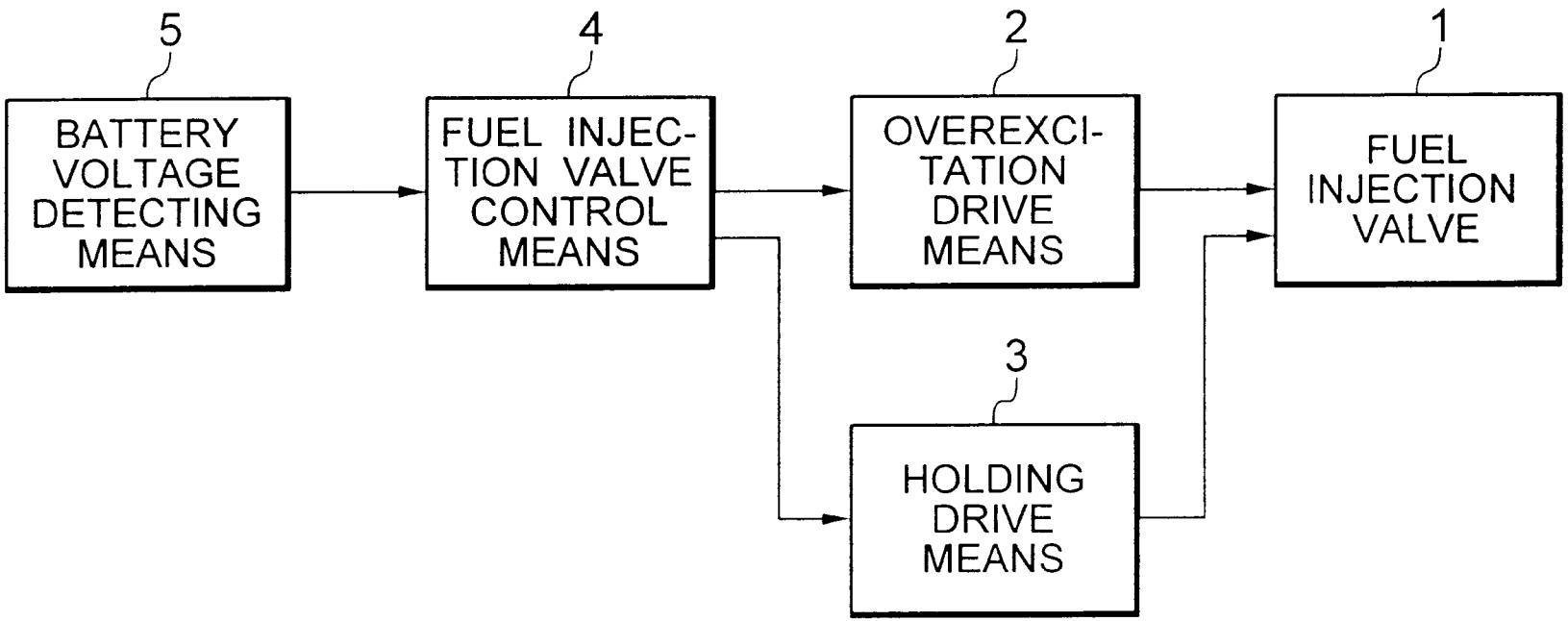
FIG. 15 (PRIOR ART)
FIG. 15 is a schematic block diagram showing a system configuration of a conventional fuel injection control system known heretofore for a cylinder injection type internal combustion engine.
Figure 16:
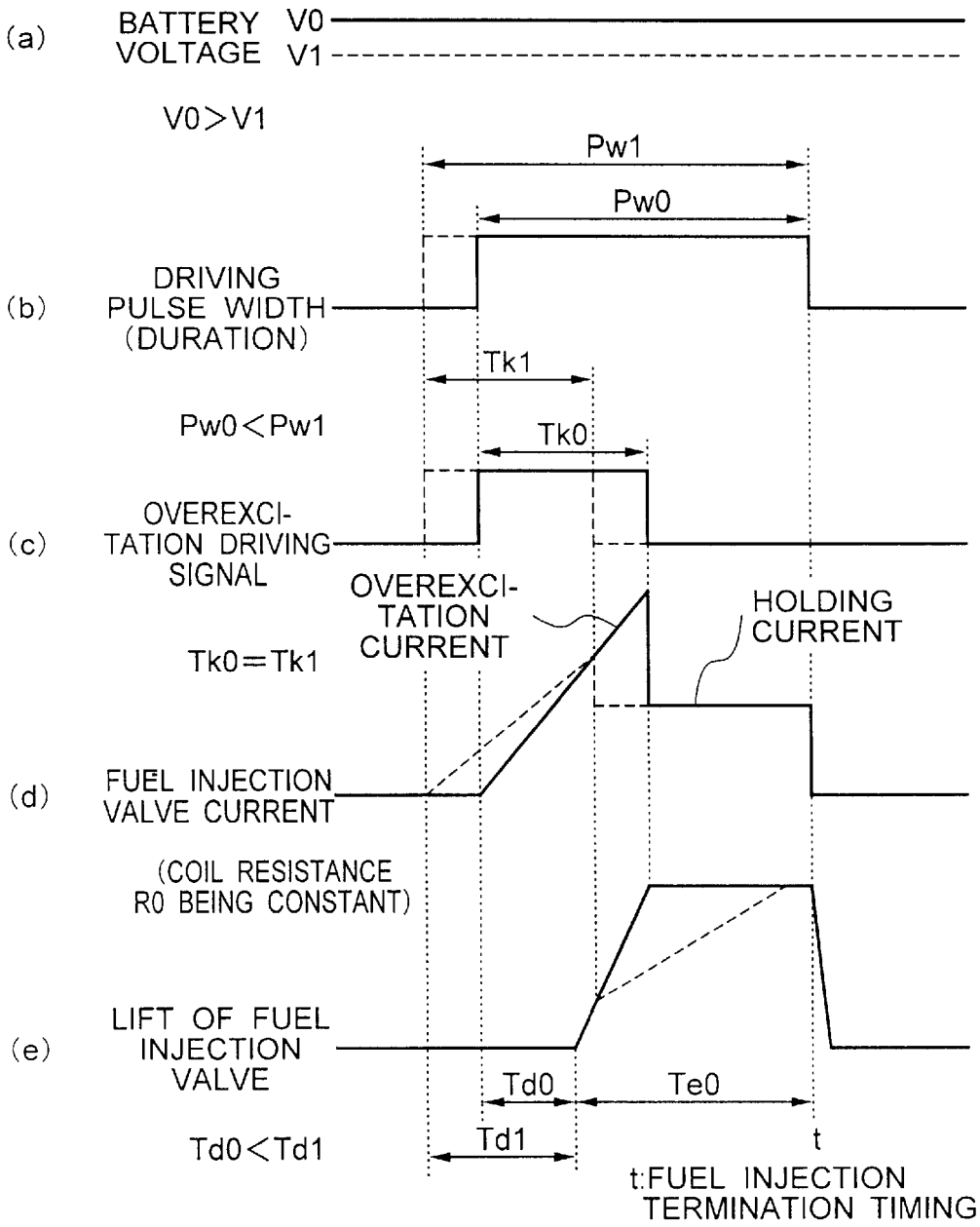
FIG. 16 (PRIOR ART)
FIG. 16 is a timing chart for illustrating fuel injecting operation upon change of a battery voltage in the conventional fuel injection control system.
Figure 17:
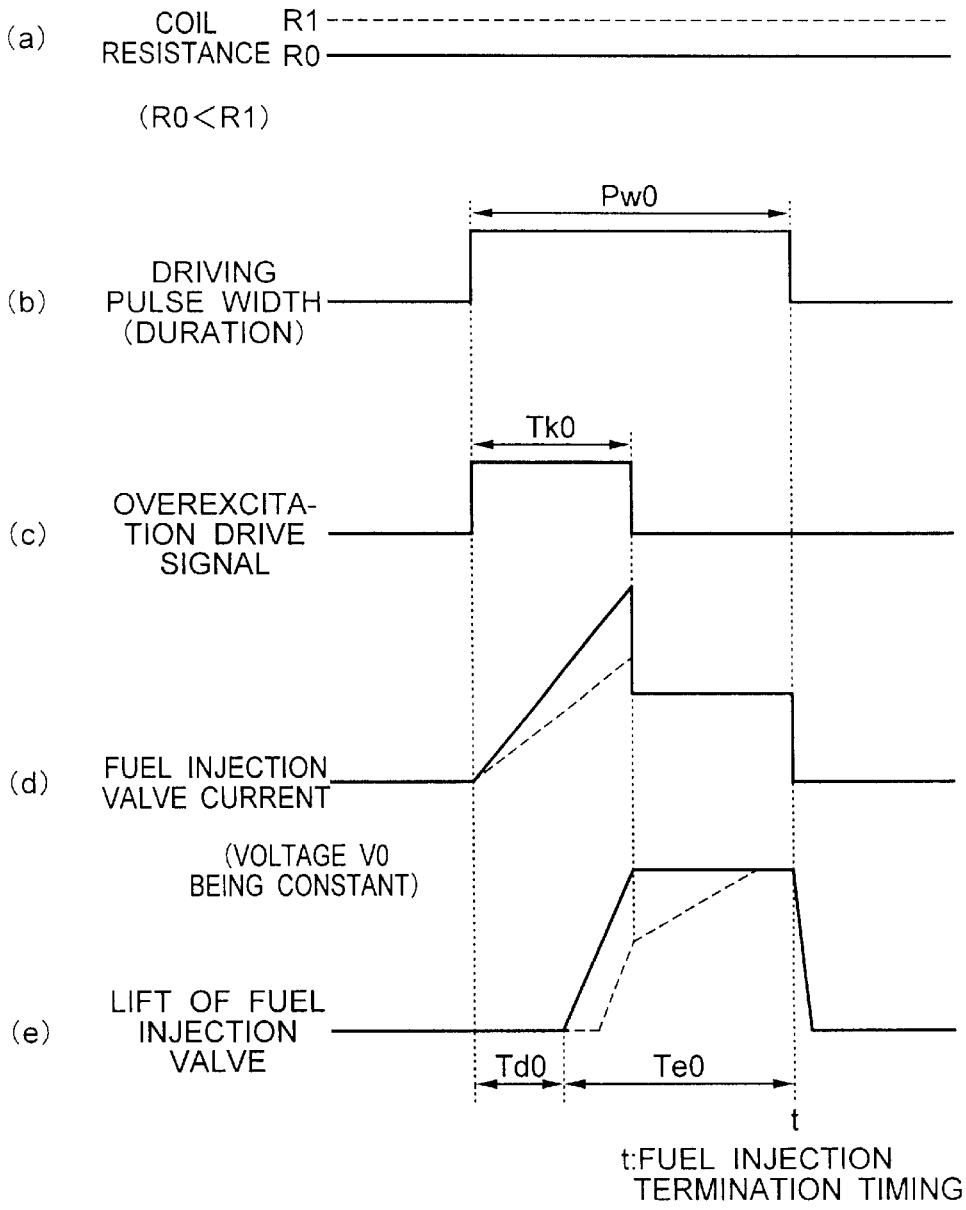
FIG. 17 (PRIOR ART)
FIG. 17 is a timing chart for illustrating fuel injecting operation upon change of resistance of a plunger coil of a fuel injector in the conventional fuel injection control system.

By way of example, the fuel injection valve control means 4, the switching time-point change means 6 and the dead time change means 9 may be implemented by a single microcomputer or microprocessor programmed correspondingly. Of course, the arithmetics involved in carrying out the invention as well as the processing procedures such as illustrated in FIGS. 13, 14 and 15 may be stored as program modules in a recording medium.

Accordingly, all suitable modifications and equivalents may be resorted to, falling within the spirit and scope of the invention.

What is claimed is:

1. A fuel injection control system for a cylinder injection type internal combustion engine, comprising:

an electromagnetic fuel injection valve for injecting fuel directly into an engine cylinder;

means for outputting an overexcitation current for opening said fuel injection valve from a vehicle-onboard power supply unit mounted on a motor vehicle equipped with said cylinder injection type internal combustion engine to said fuel injection valve during a predetermined overexcitation time duration conforming to a power supply voltage of said power supply unit;

means for outputting a holding current smaller than said overexcitation current from said vehicle-onboard power supply unit to said fuel injection valve for holding said fuel injection valve in a valve open state;

means for changing over output operation of said overexcitation drive means with output operation of said outputting means to thereby control driving operation for said fuel injection valve;

means for detecting the output voltage of said power supply unit; and means for changing a time point for switching the output operation of said overexcitation drive means to the output operation of said outputting means for said fuel injection valve control means in dependence on the voltage detected by said voltage detecting means.

2. A fuel injection control system for a cylinder injection type internal combustion engine according to claim 1, further comprising:

means for averaging the detected voltage detected by said voltage detecting means;

wherein said switching time-point change means is so designed as to change correspondingly the time point for switching the output operation of said overexcitation drive means to the output operation of said outputting means in dependence on an averaged voltage determined by said averaging means.

3. A fuel injection control system for a cylinder injection type internal combustion engine according to claim 1, wherein said switching time-point change means is designed such that when the voltage of said power supply unit detected in the course of outputting said overexcitation current is lower than the voltage on the basis of which the currently validated overexcitation time duration has been determined, said switching time-point change means sets again said currently validated overexcitation time duration in dependence on said detected voltage, to thereby change correspondingly the time point for switching the output operation of said overexcitation drive means to the output operation of said holding drive means.

4. A fuel injection control system for a cylinder injection type internal combustion engine according to claim 3, further comprising:

means for averaging the detected voltage detected by said voltage detecting means;

wherein said switching time-point change means is so designed as to change correspondingly the time point for switching the output operation of said overexcitation drive means to the output operation of said outputting means in dependence on an averaged voltage determined by said averaging means.

5. A fuel injection control system for a cylinder injection type internal combustion engine, comprising:

an electromagnetic fuel injection valve that injects fuel directly into an engine cylinder;

an overexcitation current outputting device that opens said fuel injection valve from a vehicle-onboard power supply unit mounted on a motor vehicle equipped with said cylinder injection type internal combustion engine to said fuel injection valve during a predetermined overexcitation time duration conforming to a power supply voltage of said power supply unit;

a holding current outputting device that outputs a holding current smaller than said overexcitation current from said vehicle-onboard power supply unit to said fuel injection valve that holds said fuel injection valve in a valve open state;

a device that changes over output operation of said overexcitation drive outputting device with output operation of said holding current outputting device to thereby control driving operation for said fuel injection valve;

a detector that detects the output voltage of said power supply unit; and a device that changes a time point for switching the output operation of said overexcitation drive outputting device to the output operation of said holding current outputting device for said fuel injection valve control in dependence on the voltage detected by said voltage detector.

6. A fuel injection control system for a cylinder injection type internal combustion engine according to claim 5, further comprising:

a device that averages the detected voltage detected by said voltage detector;

wherein said device that changes the time point is so designed as to change correspondingly the time point for switching the output operation of said overexcitation drive outputting device to the output operation of said outputting device in dependence on an averaged voltage determined by said averaging device.

* * * * *